US011359347B2

(12) United States Patent
White

(10) Patent No.: US 11,359,347 B2
(45) Date of Patent: Jun. 14, 2022

(54) FOUNDATION PIER SYSTEM AND METHOD OF USE

(71) Applicant: Mark White Fabrication, LLC, Olathe, KS (US)

(72) Inventor: Mark White, Olathe, KS (US)

(73) Assignee: Mark White Fabrication, LLC, Olathe, KS (US)

( * ) Notice: Subject to any disclaimer, the term of this patent is extended or adjusted under 35 U.S.C. 154(b) by 0 days.

(21) Appl. No.: 17/011,692

(22) Filed: Sep. 3, 2020

(65) Prior Publication Data

US 2021/0131053 A1 May 6, 2021

Related U.S. Application Data

(62) Division of application No. 16/671,919, filed on Nov. 1, 2019, now Pat. No. 10,801,173.

(51) Int. Cl.

| | |
|---|---|
| ***E02D 35/00*** | (2006.01) |
| ***E02D 5/52*** | (2006.01) |
| ***E02D 5/22*** | (2006.01) |
| ***E02D 27/48*** | (2006.01) |

(52) U.S. Cl.

CPC ..... *E02D 35/005* (2013.01); *E02D 5/223* (2013.01); *E02D 5/523* (2013.01); *E02D 27/48* (2013.01); *E02D 2200/115* (2013.01); *E02D 2200/1685* (2013.01)

(58) Field of Classification Search

CPC ..... E02D 35/00; E02D 35/005; E02D 27/48
USPC ..... 405/230
See application file for complete search history.

(56) References Cited

U.S. PATENT DOCUMENTS

| | | | | |
|---|---|---|---|---|
| 3,902,326 | A * | 9/1975 | Langenbach, Jr. | E02D 27/48 405/230 |
| 4,338,047 | A * | 7/1982 | David | E02D 27/48 405/230 |
| 4,591,466 | A | 5/1986 | Murray et al. | |
| 4,708,528 | A | 11/1987 | Rippe | |
| 5,116,355 | A | 5/1992 | Freeman, III | |
| 5,228,807 | A * | 7/1993 | Willcox, Jr. | E02D 5/60 405/232 |

(Continued)

FOREIGN PATENT DOCUMENTS

| | | |
|---|---|---|
| GB | 2 024 283 A | 1/1980 |
| JP | S60-95028 A | 5/1985 |
| WO | 2008/039225 A2 | 4/2008 |

OTHER PUBLICATIONS

"Helical Pier Installation," Power Jack Foundation Repair, pjfr.com, accessed at https://www.pjfr.com/foundation-repair/foundation-problems/settlement-sinking/helical-pier-installation.html, accessed on Mar. 2018, p. 2.

(Continued)

*Primary Examiner* — Frederick L Lagman
(74) *Attorney, Agent, or Firm* — Shook Hardy & Bacon L.L.P.

(57) ABSTRACT

A foundation support system and method of installing the foundation support system. The foundation support system includes a pier system for providing support beneath a foundation, a support member, and a heave plate attachable to a bottom surface of the foundation. The method includes driving a pier system using a ram, coupling a support member to the heave plate, and engaging the support member with the pier system.

17 Claims, 11 Drawing Sheets

(56) References Cited

U.S. PATENT DOCUMENTS

| | | | | |
|---|---|---|---|---|
| 5,399,055 | A | 3/1995 | Dutton, Jr. | |
| 5,433,556 | A | 7/1995 | Freeman, III | |
| 5,492,437 | A | 2/1996 | Ortiz | |
| 5,800,094 | A | 9/1998 | Jones | |
| 6,079,905 | A | 6/2000 | Ruiz et al. | |
| 6,142,710 | A | 11/2000 | Holland, Jr. et al. | |
| 6,352,390 | B1 * | 3/2002 | Jones | E02D 27/48 405/230 |
| 6,468,002 | B1 | 10/2002 | Gregory et al. | |
| 6,503,024 | B2 | 1/2003 | Rupiper | |
| 6,539,685 | B2 * | 4/2003 | Bell | E02D 35/00 405/229 |
| 6,609,856 | B1 | 8/2003 | Knight | |
| 6,659,692 | B1 | 12/2003 | May | |
| 6,767,167 | B1 | 7/2004 | Rials | |
| 6,951,437 | B2 | 10/2005 | Hall | |
| 7,094,003 | B2 | 8/2006 | Faires et al. | |
| 7,470,090 | B2 | 12/2008 | Heppner | |
| 7,744,316 | B2 * | 6/2010 | Kaufman | E02D 35/005 405/230 |
| 7,857,549 | B1 * | 12/2010 | Deshazer | E02D 35/00 405/250 |
| 8,206,063 | B2 | 6/2012 | Patton | |
| 8,714,880 | B1 | 5/2014 | Mitchell | |
| 8,851,800 | B2 | 10/2014 | Patton | |
| 9,708,788 | B2 | 7/2017 | Teague et al. | |
| 10,801,173 | B1 * | 10/2020 | White | E02D 5/523 |
| 2002/0062622 | A1 * | 5/2002 | Bell | E02D 35/00 52/741.15 |
| 2005/0186034 | A1 * | 8/2005 | Hall | E02D 27/48 405/251 |
| 2006/0067794 | A1 * | 3/2006 | Mitchell | E02D 27/48 405/230 |
| 2008/0014027 | A1 * | 1/2008 | Price | E02D 37/00 405/230 |
| 2010/0021243 | A1 | 1/2010 | Dimitrijevic | |
| 2010/0080658 | A1 * | 4/2010 | Marshall | E02D 35/00 405/232 |
| 2012/0255242 | A1 * | 10/2012 | Patton | B66F 3/24 52/126.6 |
| 2016/0356013 | A1 * | 12/2016 | Teague | E02D 27/48 |

OTHER PUBLICATIONS

"Products: We Choose the Chance Helical Pile Foundation System," Solid Earth Technologies, solidearthtech.com, accessed at https://web.archive.org/web/20131207065537/http://solidearthtech.com/helical-piles/, accessed on Dec. 7, 2013, p. 1.

"Using Piers to Fix Concrete Foundations," Concrete Network, concretenetwork.com, accessed at https://web.archive.org/web/20111004021805/http://www.concretenetwork.com/concrete/foundation_repair/foundation_supports.htm, accessed on Oct. 4, 2011, p. 3.

Non-Final Office Action dated Sep. 14, 2021 in U.S. Appl. No. 17/011,702, 11 pages.

Final Office Action dated Mar. 10, 2022 in U.S. Appl. No. 17/011,702, 9 pages.

* cited by examiner

FOUNDATION PIER SYSTEM AND METHOD OF USE

CROSS-REFERENCE TO RELATED APPLICATIONS

This application is a divisional of U.S. Nonprovisional application Ser. No. 16/671,919, entitled Foundation Pier System and Method of Use, filed Nov. 11, 2019. The entirety of the aforementioned application is incorporated by reference herein.

FIELD

Aspects provided relate to foundation jacking assemblies. More particularly, aspects herein relate to jacking assemblies using pier systems.

BACKGROUND

When foundations of above-ground structures (e.g., residential houses, and commercial buildings) settle, foundation jacking tool assemblies are used to raise the foundation to a stabilized position. For example, a method of raising the foundation may include digging holes at spaced-apart intervals, exposing the foundation. Then a bracket's horizontal portion may be slid under an edge of the foundation and a vertical portion may be attached to or otherwise positioned alongside of a side of the foundation. Next, a screw anchor or pier shaft may be driven into the ground adjacent the foundation until bedrock or a load-bearing stratum is reached. In some previous systems, a large hydraulic ram was placed in in each of the excavated holes to drive the pier shaft or screw anchor. These large hydraulic rams included a driving portion that extended under the foundation to drive the screw anchor or pier shaft beneath the foundation. Each of the holes dug out, however, must be very large to accommodate the size of these large hydraulic rams. In addition to the inefficient excavation, these large hydraulic rams required additional equipment to be lifted out of one hole and into another.

Other systems have avoided using large hydraulic rams and therefore avoided digging very large holes by using a smaller, hand-held hydraulic driving cylinder. These smaller, hand-held hydraulic driving cylinders are typically placed between a bottom surface of a foundation and a top of a pier shaft. As the driving cylinder extends, the pier shaft is driven beneath the foundation. In order to avoid deep excavation for each hole beneath the foundation each pier shaft comprises a plurality of short segments that are each separately driven. This process requires the smaller, hand-held hydraulic driving cylinder to be removed and repositioned after each individual segment of the pier shaft system is driven into the ground. For example, following excavation this process requires (1) positioning a pier segment at the desired location; (2) positioning the hand-held hydraulic cylinder between the foundation and the pier segment; (3) driving the pier segment with the hand-held hydraulic cylinder; and (4) removing the hand-held hydraulic cylinder. Often, this process must be repeated (in some cases as many as 50-60 times).

SUMMARY

Aspects of the present invention provide a foundation support system and method of installing the foundation support system which advantageously allows for a pier system to be installed directly below and not merely adjacent to the foundation. Specifically, the foundation support system may include a pier system for providing support beneath a foundation, a support member, and a heave plate attachable to a bottom surface of the foundation. The pier system may include a plurality of pier members driven into the ground below the heave plate using a ram removably coupled to the heave plate. The heave plate may have a bottom surface opposite a top surface and may be coupled to the foundation such that the top surface faces the foundation and the bottom surface faces the pier system. The heave plate may further have apertures extending therethrough for communicating a fastener that holds the heave plate to the foundation.

The bottom surface of the heave plate may also have a catch for removably mounting the ram for driving the pier system as well as subsequently mounting the support member therefrom by engaging with a flange of the support member. For example, the catch may include a pair of L-shaped rails spaced apart from each other. Each of the L-shaped rails may have a first portion extending away from the bottom surface of the heave plate and a second portion extending towards the other L-shaped rail.

The support member may have a first end opposite a second end. A flange may extend from the first end to create a lip held by the catch. The support member has an extendable partition that is configured to adjust a length between the first end and the second end. The length of the support member may be adjusted to engage the pier system, bridging the space between the heave plate and the top of the pier system.

In another aspect of the invention, a method of installing a concentric pier system may include the steps of affixing a heave plate to a foundation, removably coupling a ram to a catch of the heave plate, driving a pier system via the ram into ground beneath the foundation, and decoupling the ram from the catch of the heave plate. The method may then include the steps of coupling a support member to the catch of the heave plate above the pier system, lifting the foundation to a desired position, and extending an extendable portion of the support member down to the pier system until the support member engages the pier system. Lifting the foundation may include installing a pier cap and lift platform atop the pier system, placing one or more lifts on the lift platform, and lifting the foundation by extending one or more lifts upward until they have engaged the heave plate and moved the foundation to the desired position.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative aspects of the present invention are described in detail below with reference to the attached drawing figures, which are incorporated by reference herein and wherein.

Figure 1A:
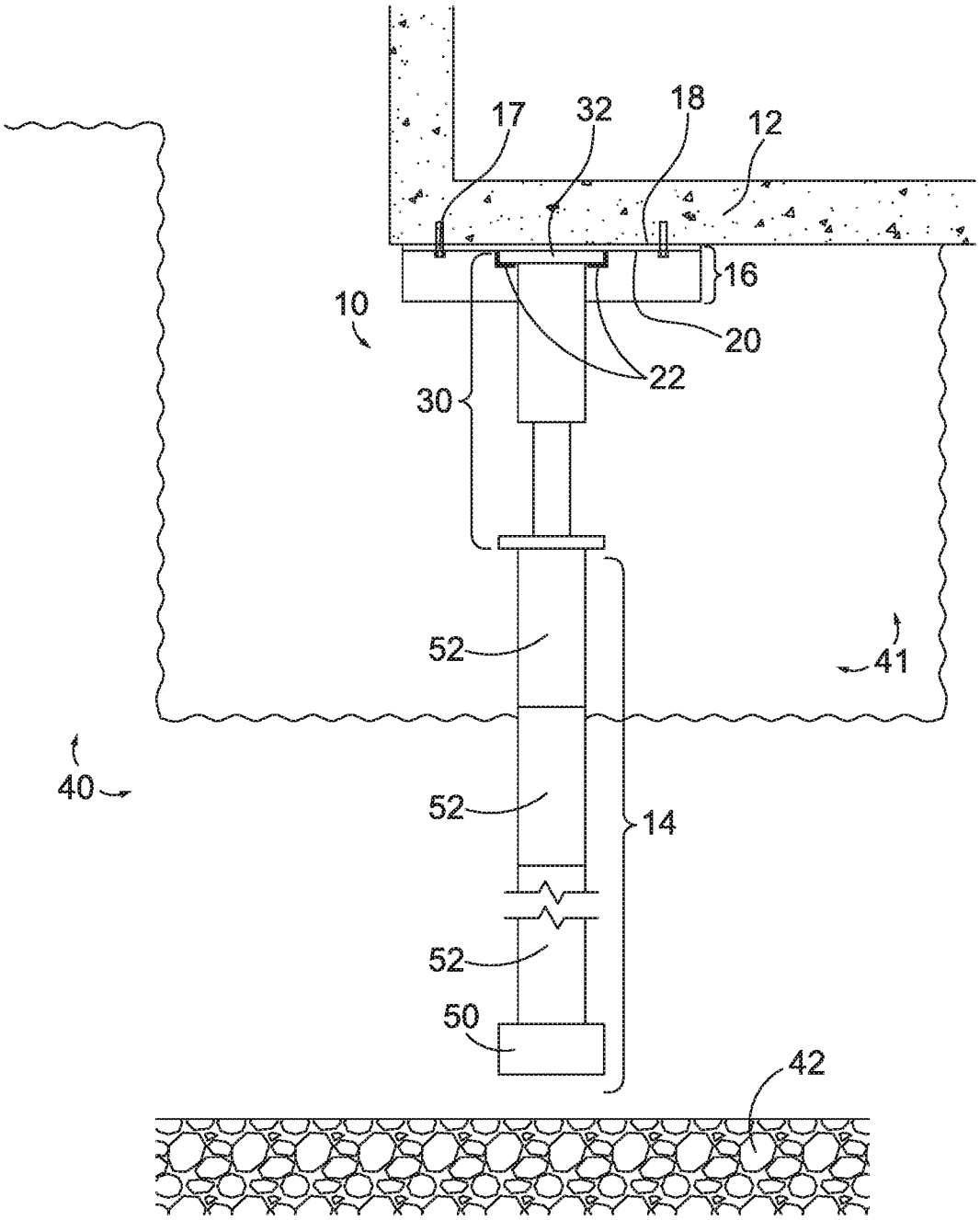
FIG. 1A is a profile view of a foundation support system with a ram suspended from a heave plate and driving a pier system, in accordance with aspects hereof.

The drawing figures do not limit the present invention to the specific aspects disclosed and described herein. The drawings are not necessarily to scale, emphasis instead being placed upon clearly illustrating the principles of the invention.

DETAILED DESCRIPTION

The subject matter of aspects of the present invention is described with specificity herein to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the aspects herein and may have various components hidden to aid in the written description thereof.

At a high level, a foundation support system may include a pier system configured to provide support beneath a foundation, a heave plate attachable to the foundation, and an extendable support member configured to bridge a space between the heave plate and the pier system. In some aspects, the foundation support system may also include a ram detachably coupled to the heave plate for driving the pier system into the ground. In other aspects, the foundation support system may also include one or more lift platforms removably coupled to the pier system and one or more lifts set upon the one or more lift platforms to raise the foundation to a desired position.

Referring to FIG. 1A, various aspects of the invention provide a foundation support system 10 for lifting and/or stabilizing a foundation 12 of a structure (e.g., a house, building, etc.). The foundation support system 10 includes a pier system 14, a heave plate 16 having a top surface 18 opposite a bottom surface 20. The heave plate 16 may be coupled to the foundation 12 where the top surface 18 faces the foundation 12 and the bottom surface 20 faces the pier system 14. The heave plate 16 is contemplated to be coupled a number of ways, but is depicted as being coupled using fasteners 17 (e.g. lag bolts). The bottom surface 20 further includes a catch 22. A ram 30 is further shown, having a lip 32 that removably couples to the catch 22 of the heave plate 16. The ram 30 depicted in FIG. 1A is a hydraulic ram, but it is contemplated that any linear actuator may be suspended from the heave plate 16 to drive the pier system 14.

The pier system 14 includes at least one pier member 52. As discussed herein, the pier system 14 may include at least one pier member 52 stacked vertically beneath the heave plate 16. The pier system 14 may also include a pier base 50 coupled to the first end of the pier system 14.

As illustrated in FIG. 1A, the foundation support system 10 is positioned w/in an excavated pit 41 and beneath the foundation 12. After installation, the ram 30 may drive additional pier members 52 into a non-load bearing stratum 40 until the pier system 14 reaches a sufficient depth to support the foundation 12. In some aspects, the sufficient depth may occur when one end of the pier system 14 reaches a load bearing stratum 42 (e.g., bedrock).

Suspending the ram 30 from the catch 22 allows the foundation support system 10 to directly drive the pier system 14 with a smaller ram 30 in a smaller pit 41 without having to remove the ram 30 each time a new pier member 52 must be moved into place.

Figure 1B:
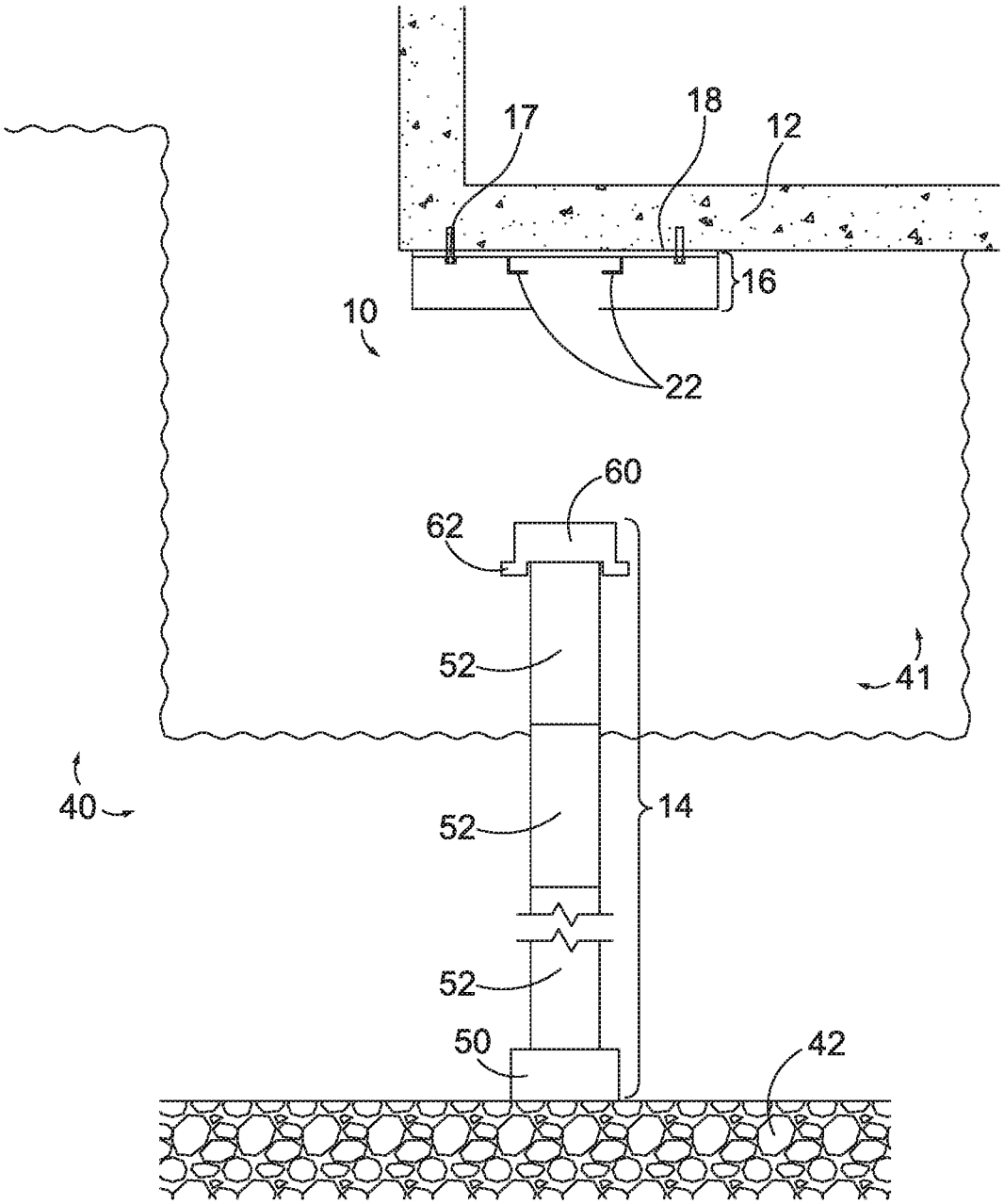
FIG. 1B is a profile view of the foundation support system of FIG. 1A with the pier system in place, a pier cap atop the pier system and the ram removed, in accordance with aspects hereof.

Referring to FIG. 1B, the pier system 14 from FIG. 1A has been driven through the non-load bearing stratum 40 to the sufficient depth. After the pier system 14 reaches the sufficient depth, the ram 30 is uncoupled from the catch 22. Once uncoupled from the catch 22, the ram 30 may be removed from the pit 41. Also, after the pier system 14 reaches the sufficient depth, a pier cap 60 may be placed on the protruding end of the pier member 52. Before placing the pier cap 60 on the protruding end of the pier member 52, the pier may be filled with material (e.g. gravel, concrete, etc.), in accordance with some aspects. In some aspects, the pier system 14 includes a plurality of overlapping inner and outer pier members (as discussed herein). In those aspects, the protruding end of the last inner pier member, the last outer pier member, or both may be cut such that both the inner and the outer pier members extend the same distance from the non-load bearing stratum 40. Thus, the pier cap 60 may be placed atop the protruding end of both the inner and the outer pier members, in accordance with these aspects.

In the aspect illustrated in FIG. 1B, the pier system 14 when fully installed comprises a pier base 50, a plurality of pier members 52, and a pier cap 60. In other aspects, however, the pier system 14 could be installed without a pier base 50 and/or a pier cap 60. For example, in an aspect having concentrically aligned, vertically-overlapping inner and outer pier members 52 the vertical overlapping may be maintained by installing a first and/or last pier member 52 having a different length than the other pier members.

Figure 1D:
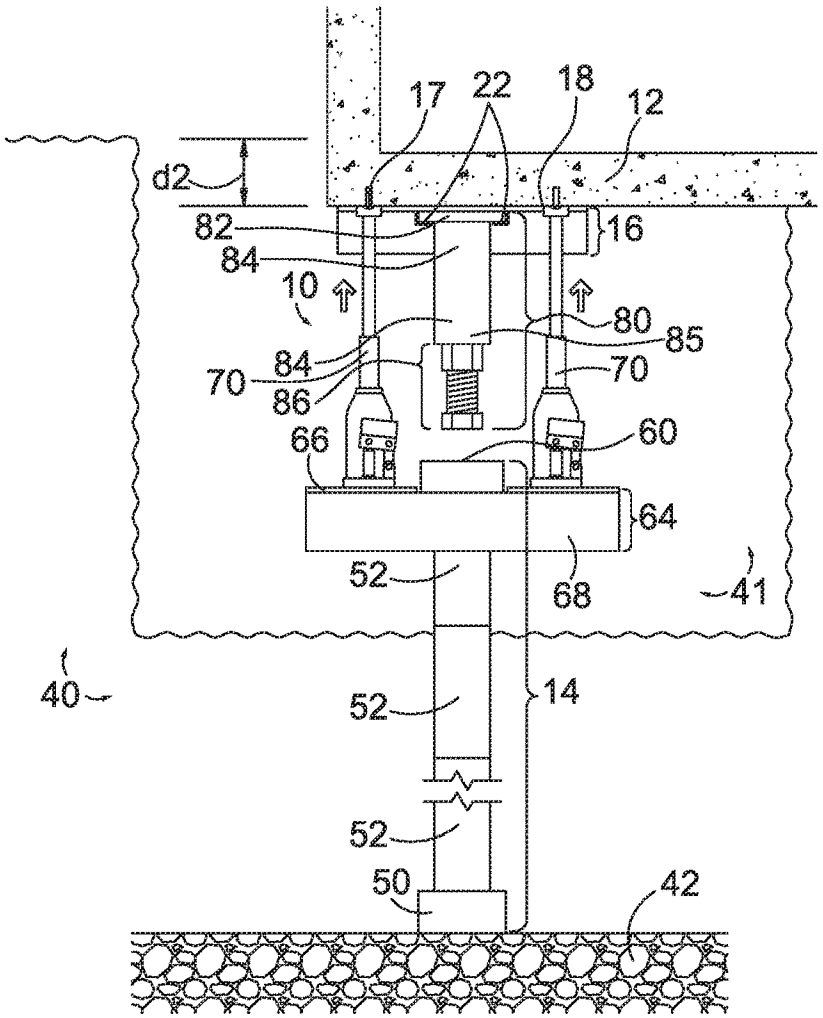
FIG. 1D is a profile view of the foundation support system of FIG. 1C with the lift system supporting the foundation in its desired position and a support member suspended from the heave plate, in accordance with aspects hereof.
Figure 1C:
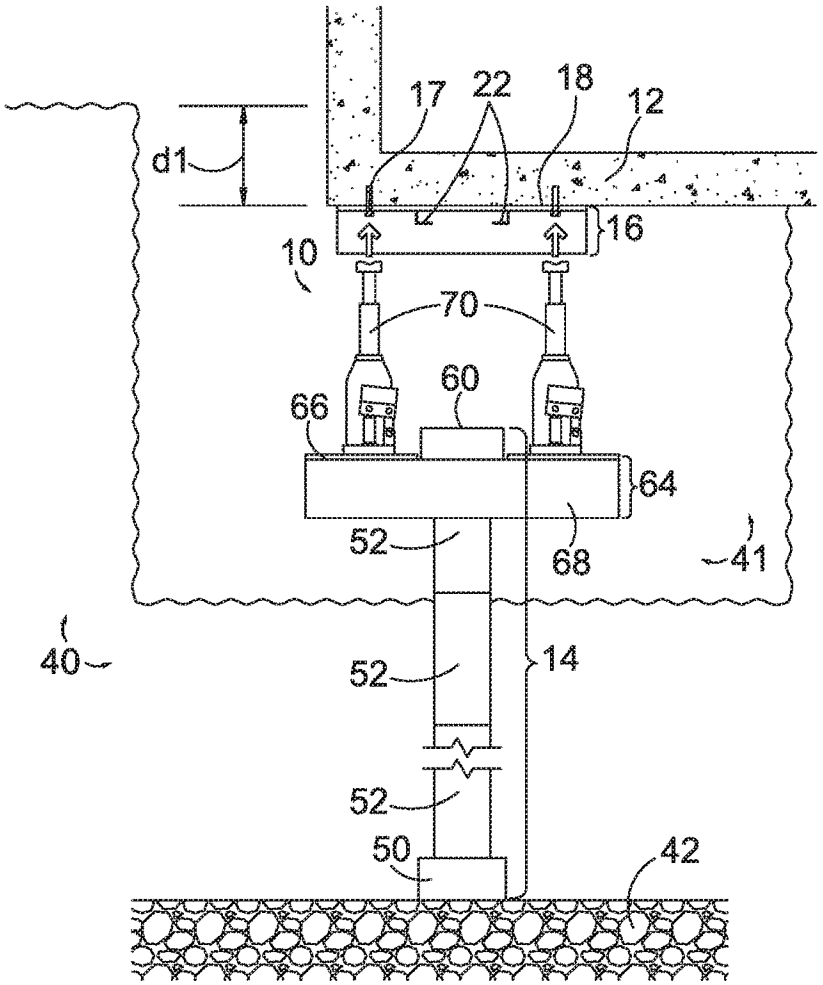
FIG. 1C is a profile view of the foundation support system of FIG. 1B with a lift platform supporting a lift system, in accordance with aspects hereof.

Referring to FIG. 1C, a lift platform 64 is coupled to the pier cap 60 and two lifting members 70 are placed on the lift platform 64. The lift platform 64 is depicted as including two plates, a top plate 66 and a bottom plate 68 (best seen in FIG. 6B). The two plates have a notch formed into an edge large enough to allow the pier cap 60 to pass through when the lift platform 64 is coupled to the pier cap 60 and small enough to catch upon a lip 62 extending from the pier cap 60. Thus, the bottom plate 68 may rest upon the lip 62 and the top plate 66 may rest upon the bottom plate 68 while the pier cap 60 passes through the notches of said plate.

The lift platform 64 supports the two lifting members 70 in accordance with some aspects. The two lifting members 70 are depicted as two hydraulic bottle jacks, but other types of linear actuators are contemplated within the scope of the invention. In other aspects, different numbers of lifting members 70 may be used. For example, a single lifting member 70 or more than two lifting members may be used.

As depicted in FIG. 1C is a sunken condition of the foundation 12 where the foundation 12. Thus, the bottom edge of the foundation 12 is a distance d1 from the top of the non-load bearing stratum 40. To return the foundation 12 to the desired position, the foundation 12 must be raised.

Referring to FIG. 1D, the lifting members 70 have extended to engage the heave plate 16 and raised the foundation 12 so that the bottom edge is now only a second distance from the top of the non-load bearing stratum 40. The distance d2 from FIG. 1D is less than the distance d1 from FIG. 1C. The distances d1 and d2 are depicted as the respective distances the foundation 12 is below the top of the non-load bearing stratum 40. However, it is contemplated the distances d1 and/or d2 may be any relative distance from a common reference point (e.g., from the load bearing stratum 42 from the pier cap 60, etc.).

FIG. 1D also a depicts support member 80 in an installed position. The support member 80 has a first end 84 and a second end 85. The support member 80 includes a flange 82 at the first end 84 and is coupled to the catch 22. The support member 80 also has an extendable portion 86 extending away from the second end 85, and is configured to engage the pier system 14. As depicted in FIG. 1D, the support member 80 can be a screw lift such that turning the extendable portion 86 increases or decreases the length of the support member 80. For example, one aspect of the support member 80 comprises a housing extending from the first end 84 towards the second end 85. The housing includes a cylindrical chamber for receiving at least a portion of the extendable portion 86. The end of the housing opposite the first end 84 is open and may have a threaded nut affixed thereto (e.g. by welding). The extendable portion 86 may comprise threaded bar stock that cooperates with the threaded nut to communicate the extendable portion 86 into and out of the housing. A terminal end of the extendable portion 86 may be configured to engage the pier cap 60. The terminal end of the extendable portion 86 may include a flat surface, which may be formed by cutting the end of the barstock. In other aspects, an engagement member may be coupled to the terminal end of the extendable portion 86.

Figure 1E:
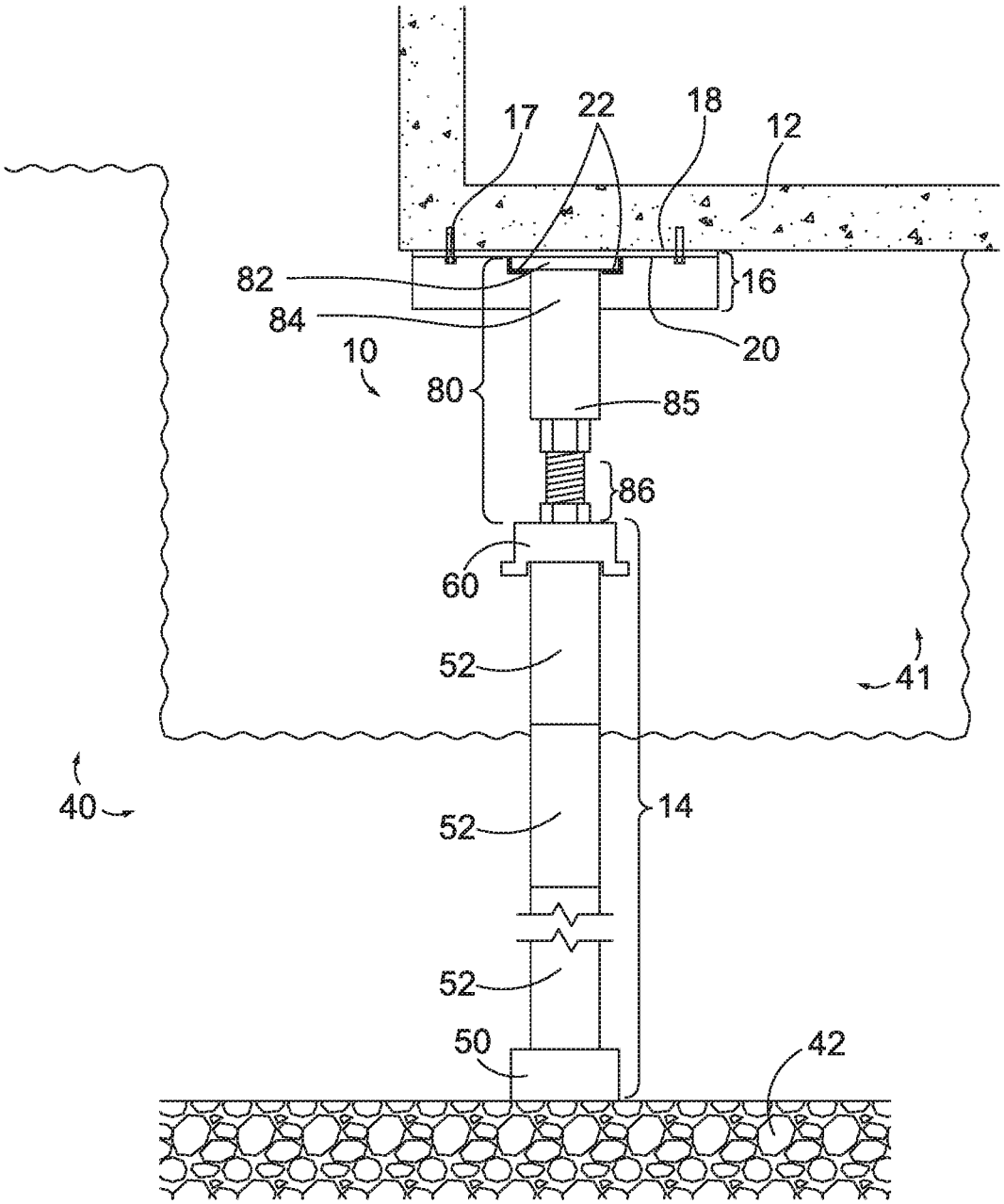
FIG. 1E is a profile view of a foundation support system of FIG. 1D with the support member extended to engage the pier cap to support the foundation and the lift platform and lift system removed, in accordance with aspects hereof.

Referring to FIG. 1E, the support member 80 has been extended so that the extendable portion 86 engages the pier cap 60 to support the foundation 12 in its raised position. After the support member 80 engages the pier cap 60, a portion of the load from the foundation 12 and carried by the lifting members 70 is transferred to the support member 80. The remaining portion of the load from the foundation 12 is transferred to the support member 80 when the lifting members 70 are removed as well as the lift platform 64, as shown in FIG. 1E. In this way the lift platform can be reused which saves materials versus prior lift platforms that remained in the excavated pit 41. After the lifting members 70 and the lift platform 64 are removed from the excavated pit 41, the pit 41 may be filled in around the foundation support system 10.

Figure 2A:
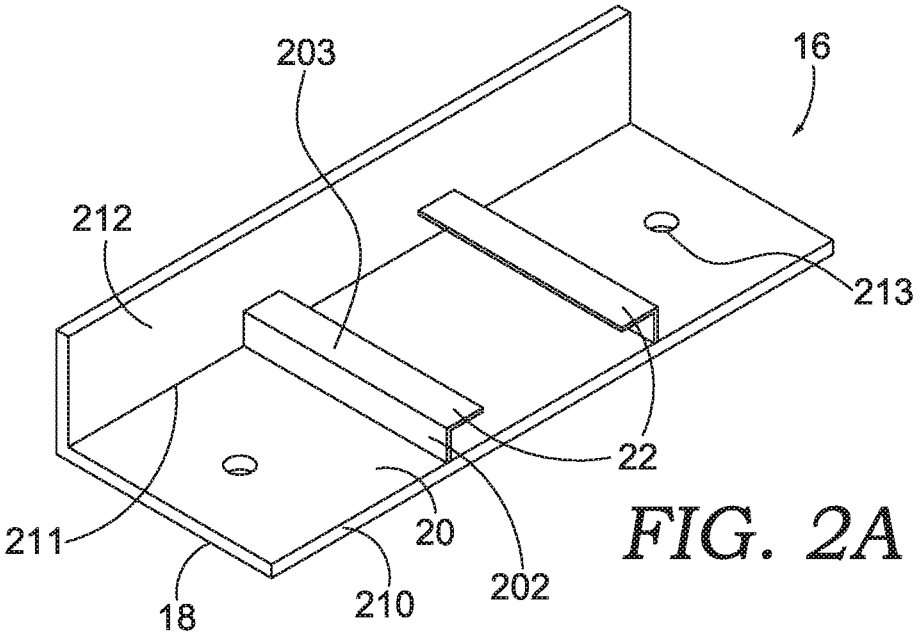
FIG. 2A is a perspective view of the heave plate of FIGS. 1A-1E, in accordance with aspects hereof.
Figure 2B:
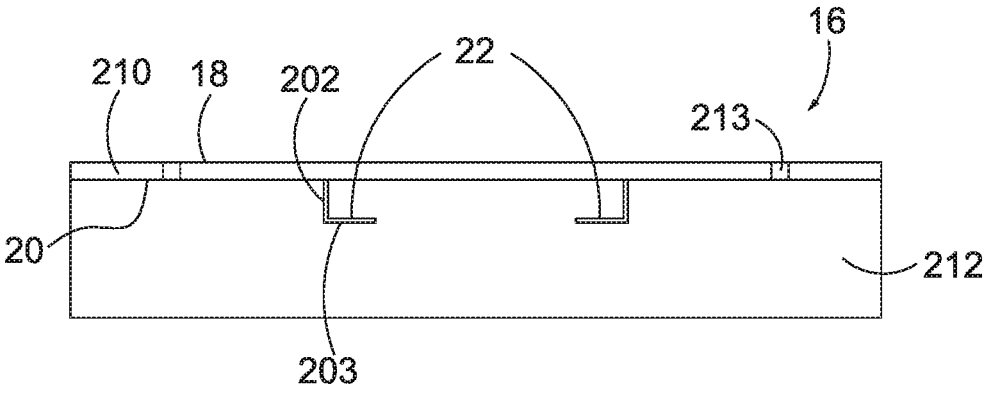
FIG. 2B is a front elevation view of the heave plate of FIG. 2A, in accordance with aspects hereof.

Two views of the heave plate 16 are depicted in FIGS. 2A and 2B. The heave plate 16 includes the top surface 18, the bottom surface 20, and the catch 22. The heave plate 16 may include a front edge 210, a back edge 211 opposite the front edge 210, and a heave plate flange 212 at the back edge 211 of the heave plate. The catch 22 may be any structure configured for coupling with the support member 80 and/or the ram 30 (as shown in FIGS. 1A-1E). For example, the catch 22 may comprise two reciprocal L-shaped or right angled rails or brackets welded to, integrally formed with, or otherwise attached to the bottom surface 20. In this aspect, each L-shaped rail of the pair of L-shaped rails may have a first portion 202 coupled (e.g., welded) to the bottom surface 20. Each L-shaped rail may further comprise a second portion 203 extending towards the other L-shaped rail. The L-shaped rails may be spaced apart such that the housing of the ram 30 or the support member 80 pass in the gap between the second portions 203 while the lip 32 or flange 82 of the ram 30 or the support member 80 may slide into the catch 22 from the side and be suspended from the second portions 203. The heave plate 16 may include a heave plate flange 212 the L-shaped rails may abut the heave plate flange 212 such that the ram 30 and/or the support member 80 cannot slide out of the catch 22 on that side of the L-shaped rails. In some aspects, the L-shaped rails may be spaced away from the heave plate flange 212.

The heave plate 16 is also shown with mount points 213 for fasteners 17 to secure the heave plate 16 to the foundation 12.

Figure 3A:
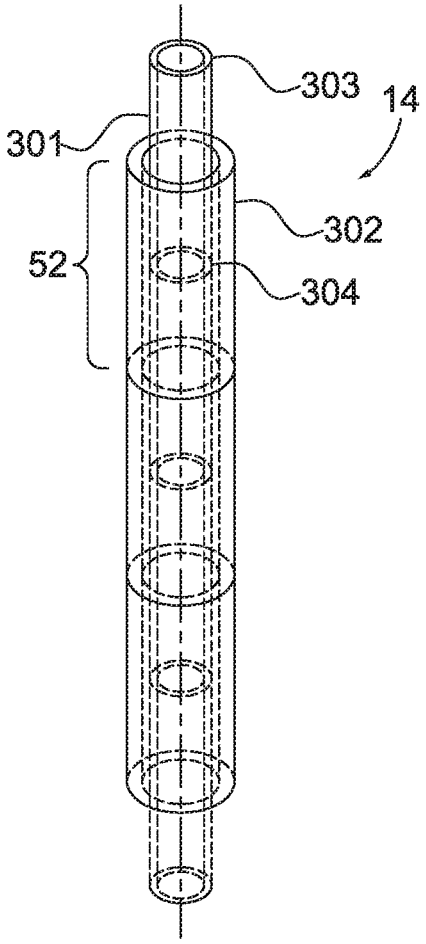
FIG. 3A is a front perspective view of the pier system of FIGS. 1A-1E, in accordance with aspects hereof.

FIG. 3A illustrates a perspective view of a portion of the assembled pier system 14. The assembled pier system 14 may include at least one pier member 52. For example, the pier system 14 of the illustrated aspect includes a plurality of inner pier sections 301 and a plurality of outer pier sections 302. The plurality of outer pier members 302 and the plurality of inner pier members 301 may be stacked concentrically so when assembled, the ends of each inner pier member 301 are offset vertically from the ends of a respective outer pier member 302. For example, the outer pier members 302 may comprise tubing having an inner diameter and the inner pier members 301 may comprise tubing having an outer diameter that is smaller than the inner diameter of the outer pier members 302.

Figure 3B:
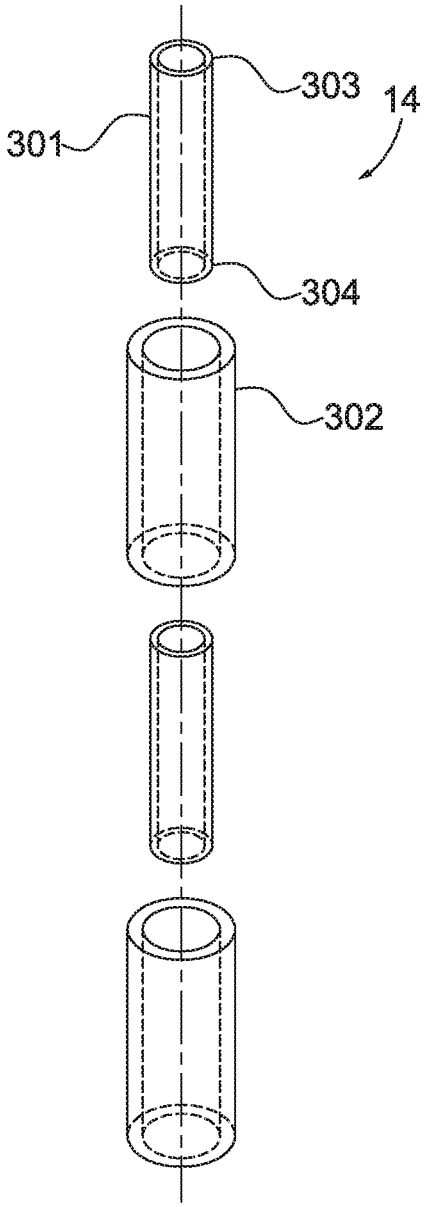
FIG. 3B is an exploded perspective view of the pier system of FIG. 3A, in accordance with aspects hereof.

In some aspects, the first end 303 and second end 304 of the inner pier member 301 terminate at the midpoint of the outer pier member 302. In other aspects, a vertical alignment between the outer pier members 302 and the inner pier members 301 may be staggered such that a portion of outer pier members 302 overlaps a portion of an inner pier member 301 as illustrated in FIGS. 3A and 3B. Thus, the pier system 14 having a plurality of inner pier members 301 concentrically aligned and vertically staggered from a plurality of outer pier members 302, can advantageously provide additional strength to the pier system 14 even when each pier member is short in length. The overlapping configuration resists lateral forces applied to the pier system 14. Further, utilizing a plurality of stackable pier members (e.g. 301, 302) having a short longitudinal length minimize the required excavation of the pit 41.

The outer pier members 302 may be comprised of steel tubing or any other suitable material known in the art. The wall thickness of the steel tubing may be about 0.080 inches to about 0.250 inches thick, in accordance with some aspects.

FIG. 3B displays an exploded view of the portion of the assembled pier system 14.

Although FIGS. 3A and 3B show the assembled pier system 14 as a concentric pier system comprised of round tubing, it is contemplated that any configuration of pier members 52 may be used without departing from the scope of the invention. The outer pier members 302 may be configured to be stacked on top of each other, end-to-end. Similarly, the inner pier members 301 may be configured to be stacked on top of each other, end-to-end. In this way, a plurality of inner pier members 301 and outer pier members 302 can be used to adjust the necessary length of the pier system 14 as needed to reach the load bearing stratum 42 (shown in FIG. 1A-1E). It is also contemplated that although the pier members 52 are shown as cylindrical, any geometry may be used without departing from the scope of the invention.

Figure 4:
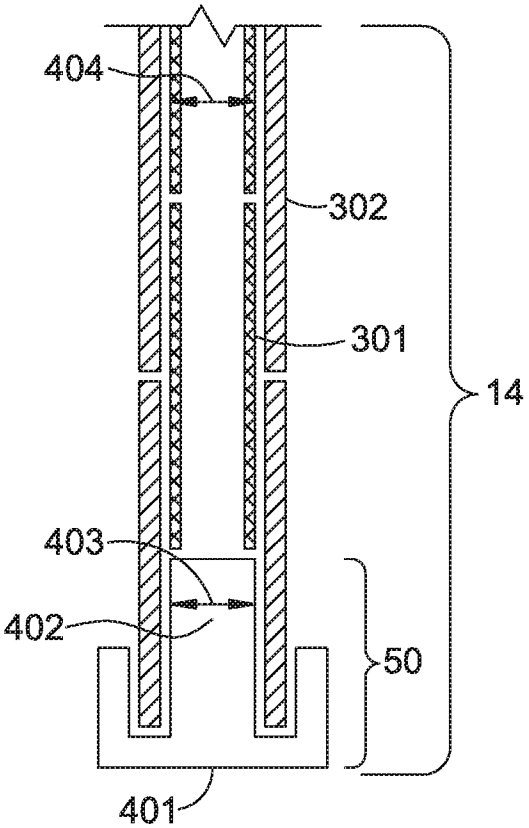
FIG. 4 is a cross sectional view of the pier base end of the pier system of FIGS. 1A-1E, in accordance with aspects hereof.

FIG. 4 illustrates a cross sectional view of a bottom end of the pier system 14. The bottom end of the pier system 14 may include a pier base 50 compiled to the one or more pier members 52 (as shown in FIGS. 1A-1E). The pier base 50 may have a bottom pier surface 401, a cylindrical wall 402 extending away from the bottom pier surface 401 and a wall diameter 403. The wall diameter 403 of the cylindrical wall 402 is equal to the second diameter 404 of the plurality of inner pier members 301. The height of the cylindrical wall 402 is configured to vertically space outer pier members 302 from respective inner pier members 301 to provide a vertical overlap between respective outer pier members 302 and inner pier members 301. It is contemplated the pier base 50 may include a driving surface that facilitates penetration of the ground. In the illustrated aspect, the pier base 50 is blunted.

Figure 5:
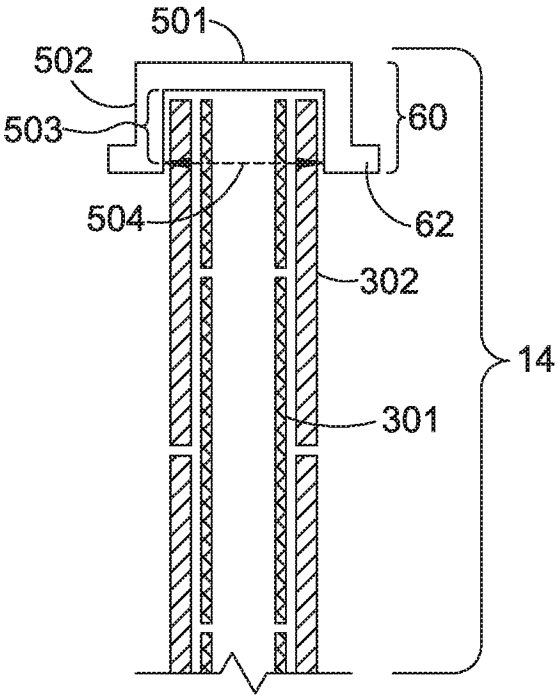
FIG. 5 is a cross sectional view of a pier cap at one end of the pier system of FIGS. 1A-1E, in accordance with aspects hereof.

FIG. 5 illustrates a cross sectional view of a top end of the pier system 14. The top end of the pier system 14 may include the pier cap 60 coupled to the one or more pier members 52. The pier cap 60 is shown having a top surface 501 and a second cylindrical wall 502 extending away from the top surface 501. The pier cap 60 further includes a lip 62 extending radially out from a bottom side of the second cylindrical wall 502 opposite the top surface 501. The pier cap 60 defines a cavity 503 into which a top end of the one or more pier members 52 may be received. The cavity 503 may have an aperture greater than or equal to the outside diameter of the outer pier members 302.

In some aspects, after the pier system 14 is driven to sufficient depth to support a load, the outer pier members 302 and/or inner piece section 301 are cut to the same height despite the offset described herein. For example, the present aspect illustrated in FIG. 5 displays both the outer piece section 302 and inner piece section 301 terminating at the same longitudinal position, which may be accomplished by cutting the ends of both members. The pier cap 60 may rest upon the cut ends of both members. Such a configuration is advantageous as it distributes the load of the foundation evenly throughout the pier system across both the inner pier section 301 and the outer pier members 302. In other aspects, the pier cap 60 may rest upon only the inner pier member 301 or only the outer pier member 302.

The pier cap 60 illustrated in FIG. 5 is cylindrical to match the geometry of the inner pier member 301 and outer pier member 302. However, in embodiments where the geometry of the inner pier member 301 and outer pier member 302 are other geometries (such as rectangular, triangular, etc.) the cavity 503 geometry of the pier cap 60 may match that geometry so the pier cap 60 can rest upon the cut ends of both members. It is contemplated in some embodiments that the outer geometry of the pier cap 60 may mirror the geometry of both members, or may be any other geometry to engage the lift platform 64.

Figure 6A:
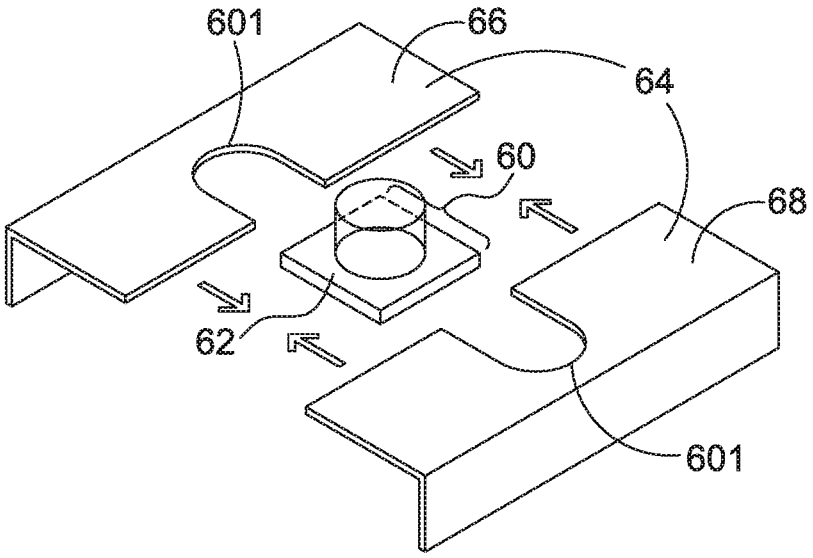
FIG. 6A is an exploded perspective view of a top plate and a bottom plate that come together with the pier cap to provide a lifting platform at the foundation support system of FIGS. 1C-1D, in accordance with aspects hereof.
Figure 6B:
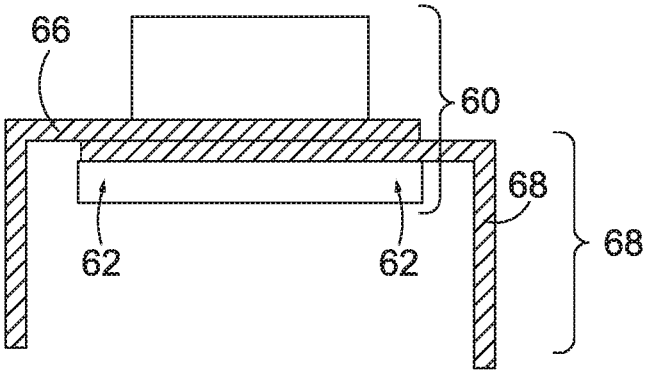
FIG. 6B is a cross hatch of the lift platform of FIG. 6A, in accordance with aspects hereof.

FIG. 6A and FIG. 6B illustrate one aspect of the lift platform 64 that may be removably installed on the pier cap 60. The top plate 66 and bottom plate 68 are depicted each having a notch 601 along an edge of the top plate 66 and the bottom plate 68. The notch 601 is large enough to allow the second cylindrical wall 502 of the pier cap 60 to pass through when the lift platform 64 is coupled to the pier cap 60. However, the notch 601 is small enough to not allow the lip 62 of the pier cap 60 to pass through. Thus, the lift platform 64 may rest upon the lip 62 when coupled to the pier cap 60.

As seen in FIG. 6B, the bottom plate 68 may rest upon the lip 62 and the top plate 66 may rest upon the bottom plate 68. Gravity may hold the top plates 66 and bottom plates 68 in position, in accordance with some aspects. In other aspects, the top plate 66 and/or the bottom plate 68 may be fastened to one another or to the pier cap 60. These overlapping plates may be mechanically fastened together or may otherwise interlock with each other and/or the pier cap 60 for temporary attachment thereto.

Although FIGS. 6A, 6B, and 1C and 1D illustrate the lift platform 64 as comprising two plates, it is contemplated that the lift platform 64 may comprise one plate or multiple plates so long as one or the combination of plates is configured to receive the pier cap 60. Further, although in the recited figures the lift platform 64 is L-shaped, it is contemplated that the lift platform 64 may have any shape or configuration capable of resting on and/or attaching to the pier cap 60 or the lip 62 of the pier cap 60. In yet another aspect, it is contemplated that the lip 62 of the pier cap 60 is large enough to become the lift platform 64. In still other aspects, the lift platform may not be removably coupled to the pier cap and it may remain in the pit 41.

Figure 7:
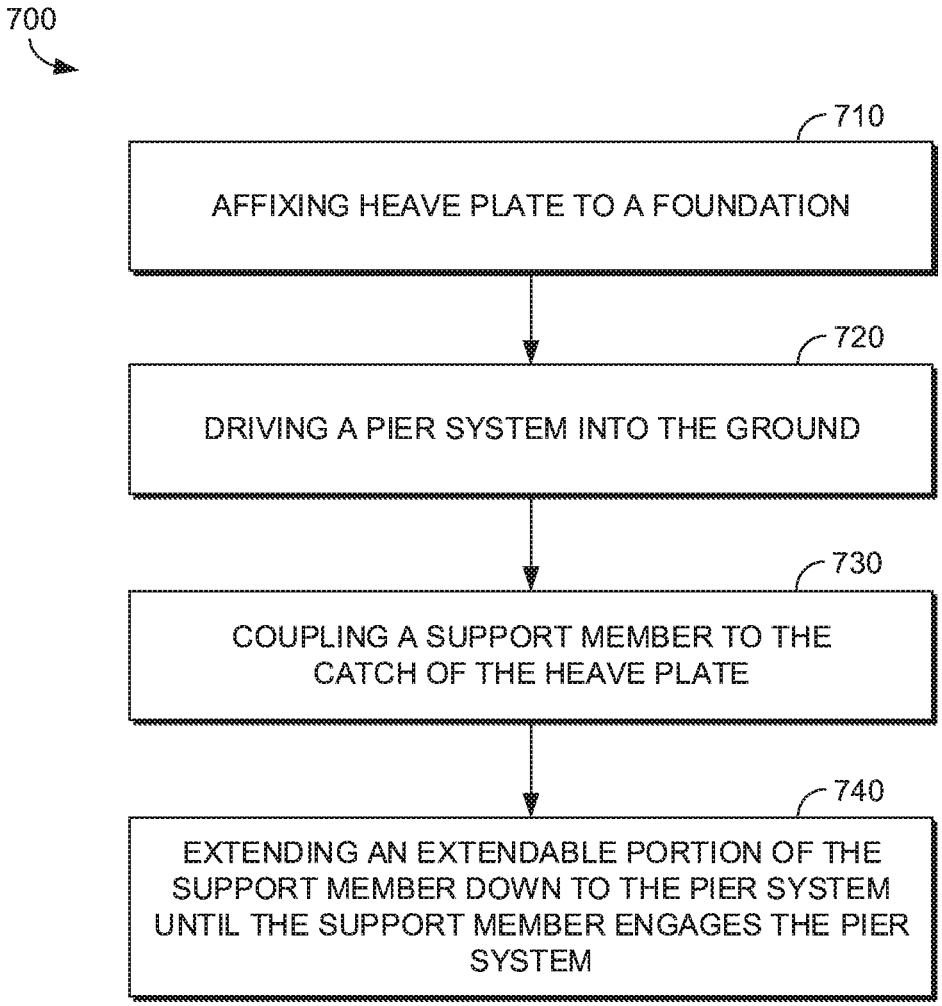
FIG. 7 is a flow chart of a method for installing a foundation support system, in accordance with aspects hereof.

The flow chart of FIG. 7 depicts an exemplary method 700 for installing a foundation support system (e.g. the foundation support system 10 discussed with respect to FIGS. 1A-1E) beneath a building's foundation (e.g. the foundation 12 discussed with respect to FIGS. 1A-1E). In some aspects the steps noted in the various blocks may occur out of the order depicted in FIG. 6. For example, two blocks shown in succession in FIG. 6 may in fact be executed substantially concurrently, or the blocks may sometimes be executed in the reverse order depending upon the functionality involved.

As illustrated in FIG. 7, the method 700 may include a step for affixing the heave plate (e.g. the heave plate 16 discussed with respect to FIGS. 1A-1E) to the foundation as depicted in block 710. This may be accomplished using any mechanical fasteners known in the art, such as bolts, screws, or the like, with the top surface of the heave plate abutting the foundation and the bottom surface of the heave plate facing downward and away from the foundation. In order to gain access to a bottom surface of the foundation, this step may follow excavation of a pit under the foundation. For example, the holes may extend downward a few feet lower than an edge of the foundation, and may further extend a few feet inward from the edge of the foundation, the holes being large enough to allow for installation of the heave plate the ram (illustrated in FIG. 1A), and at least one of the pier members (e.g. the pier members 52 illustrated in at least FIGS. 1A-1E, 3A and 3B).

The method 700 may also include a step of driving the pier system into the ground, as depicted in block 720. Specifically, this step may include removably coupling the ram to, or suspending the ram from the catch of the heave plate, and driving each of the one or more pier members into the ground with the ram. After the pier system 14 is installed, the ram may be decoupled from the catch. Driving the pier system into the ground may include driving the pier base at least partially in the ground, then stacking an inner pier member and an outer pier member and driving the pier at least partially into the non-load bearing stratum. This process may continue for adding subsequent pier members until the pier system is supported by a load-bearing stratum preventing it to be driven any deeper into the non-load bearing stratum.

The method 700 may further include the step of coupling the support member to the catch of the heave plate as depicted in block 730. This configuration is also illustrated in FIG. 1D. This step may occur following removal of the ram from the catch. Specifically, the flange of the support member may be slid between the L-shaped or right angled rails of the catch, hanging therefrom directly over the pier system. The support member may be coupled to the catch before or after the foundation is lifted. For example, once the pier system reaches a load bearing stratum, the pier cap and/or the lift platform may be installed. Before installation, the inner pier member or outer pier member may not terminate at the same location. In this situation, the additional step of cutting the inner pier member and/or outer pier member may be completed granting the pier cap direct contact with both the inner pier member and outer pier member.

Once the pier cap and lift platform are installed, the lift system may be positioned onto the lift platform. Specifically, this may include removably coupling the lift platform to the pier cap, and initiating the lift system to lift the foundation to the desired position. In some aspects, when there are a plurality of pier systems being installed to support the foundation, the lift system may be a plurality of bottle jacks. When the bottle jacks are activated, the lift system may press upward against the heave plate and potentially with a plurality of similar lift systems in other areas of the foundation by a desired amount.

Additionally, the method 700 may include a step of extending the extendable portion of the support member down to the pier system until the support member engages the pier system, as depicted in block 740. Specifically, the extendable portion may be rotated to extend until the support member fully extends from the heave plate to the pier cap. Then, the lift system may be retracted and removed and the lift platform may be removed.

However, in some alternative aspects of the invention, if the lift platform is integrally formed with the pier cap, they may remain with the pier system and only the lift system need be removed. Dirt and/or other filler materials may then be added to fill in the pit and any gaps between the foundation and the non-load bearing stratum.

As discussed above, the support member may be suspended from the heave plate by the catch and the extendable portion may be extended down to engage the pier at the pier cap. In other aspects, however, the support member may be placed upon the pier cap and the extendable portion may be extended up to engage the heave plate.

Figure 8A:
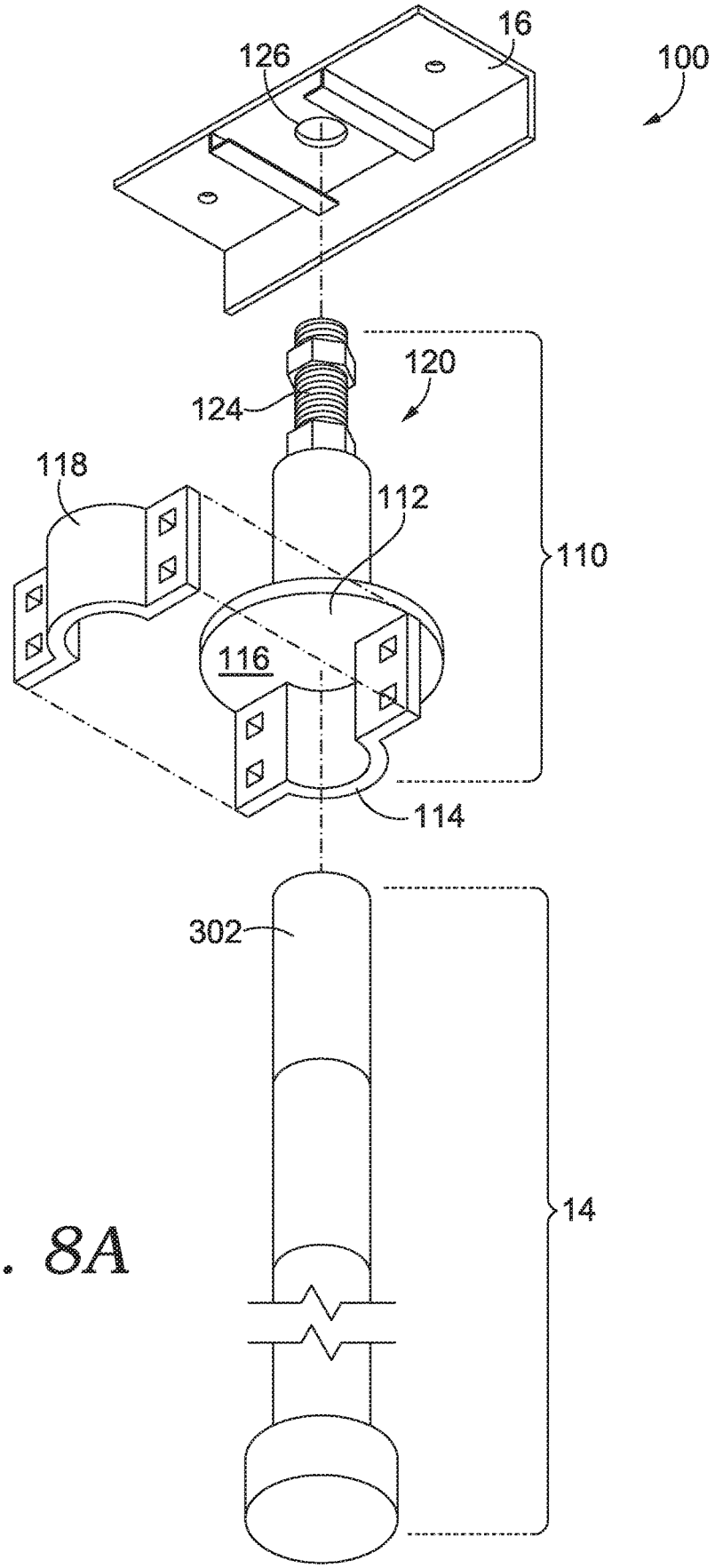
FIG. 8A is an exploded perspective view of a foundation support system, in accordance with aspects hereof.
Figure 8B:
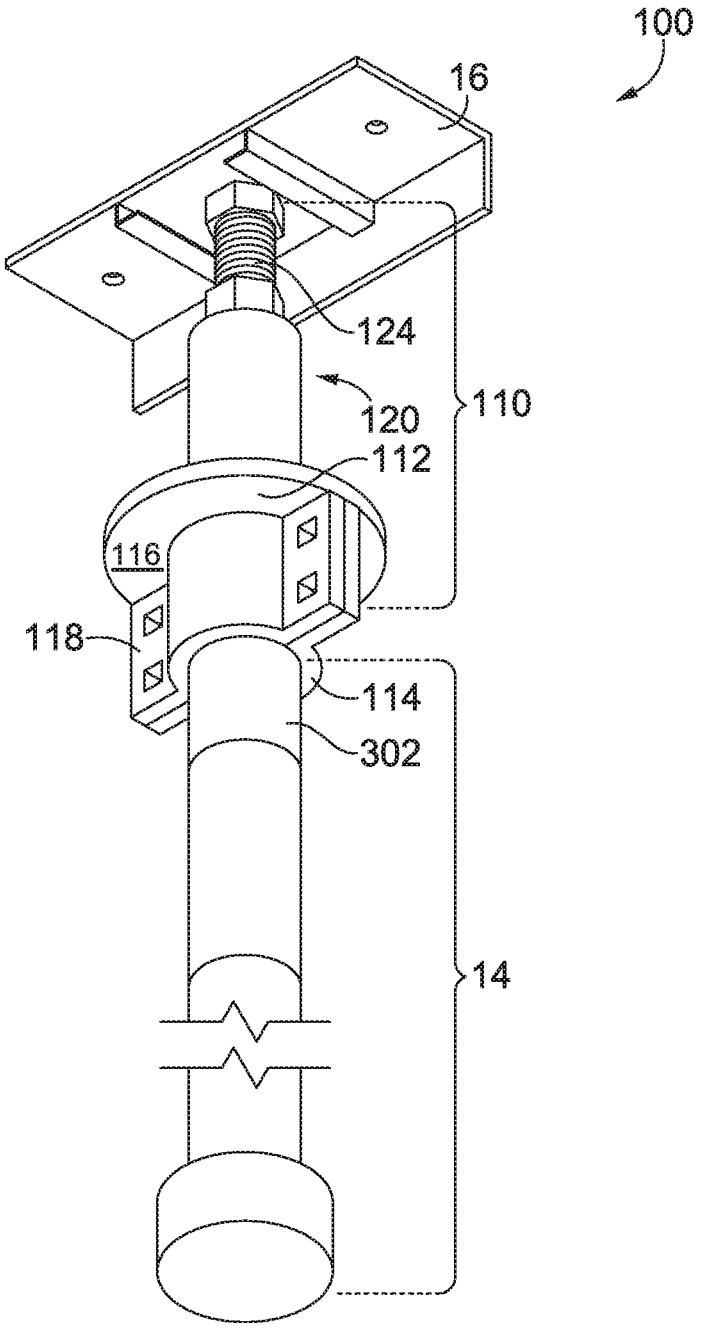
FIG. 8B is a perspective view of the foundation support system of FIG. 8A, in accordance with aspects hereof.

Turning to FIGS. 8A and 8B, an alternative aspect of a foundation support system 100 is shown. The foundation support system 100 includes many of the same components as are included in the foundation support system 10 described above in reference to FIGS. 1-6B. In FIGS. 8A and 8B like components of the foundation support system 10 are labeled with like reference numbers from FIGS. 1-6B. Thus, the foundation support system 100 may include a pier system 14 and a heave plate 16. Instead of the pier cap 60 and the support member 80, however, the foundation support system 100 includes an adjustable pier cap 110.

The adjustable pier cap 110 includes a cap plate 112 and a first collar portion 114 extending from a bottom surface 116 of the cap plate 112. The first collar portion may be fixedly attached to the cap plate (e.g., welding, brazing, fastened, etc.), in some aspects. In other aspects, the first collar portion may be integrally formed with the cap plate (e.g., cast, machined, etc.).

A second collar portion 118 may be removably fastened to the first collar portion 114 (e.g., bolts, rivets, or other suitable fasteners) to form a complete collar assembly. For example, in some aspects each of the collar portions may include wings extending from a curved body portion. The wings of these aspects may include pre-formed holes aligned to communicate fasteners therethrough. In other aspects, the second collar portion 118 may be fixed to the first collar portion 114 (e.g., welded, brazed, bonded, etc.).

The complete collar assembly may include a diameter that is larger than the diameter of the outer pier member 302, as shown in FIG. 8B. Thus, the complete collar assembly may be placed upon the top outer pier member 302 after the pier system 14 is put into position, as described above. In some aspects, the diameter of the complete collar assembly may be sized to apply a compression force against the top outer pier member 302. In other aspects, the diameter of the complete collar assembly may be sized so that it fits loosely around the top outer pier member 302 to provide some give to the system. In still other aspects, the diameter of the complete collar assembly may be smaller than the diameter of the outer pier member 302 but larger than the diameter of the inner pier member (e.g., inner pier member 301).

In addition to the collar assembly described above, the adjustable pier cap 110 also includes an extendable support portion 120. The extendable support portion 120 extends from a top surface of the cap plate 112. In some aspects, the extendable support portion 120 comprises the support member 80 affixed to the cap plate 112 (e.g., welded, brazed, bonded, fastened, etc.). Like the support member 80, the extendable support portion 120 includes a first end and a second end. The extendable support portion 120 also has an extendable portion 124 that may extend away from the second end and is configured to engage the heave plate 16. The extendable portion 124 may comprise the extendable portion 86 described above, in accordance with some aspects. The extendable portion 124 may comprise threaded bar stock that may be inserted into the extendable support portion 120. In some aspects, a threaded nut may be affixed to an end of the extendable portion 124. In further aspects, the threaded nut may be affixed at a position that is spaced away from the end of the extendable portion 124, such as a distance equal to or greater than the thickness of the heave plate 16. For example, in some aspects, the heave plate 16 may include an opening 126 (best seen in FIG. 8A) that is concentrically aligned with the pier system 14. When the adjustable pier cap 110 is installed, the extendable portion 124 may be moved toward the heave plate and the portion of the threaded bar stock extending past the threaded nut may be inserted into the opening 126 in the heave plate 16, which promotes proper alignment of, and provides lateral stability to, the integrated cap extension member 110.

This alternative foundation support system 100 operates in much the same way as the foundation support system 10, described above in reference to FIGS. 1A-1E. However, the lift platform 64 is placed upon the cap plate 112 instead of the lip 62. The notch of the lift platform 64 straddles the extendable support portion 120, in accordance with this aspect.

Additionally, although some exemplary implementations of the aspects described herein are shown in the accompanying figures, these implementations are not intended to be limiting. Rather, it should be understood that the various embodiments and aspects described herein may be implemented upon any foundation support system.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

What is claimed:

1. A foundation support system comprising:

a pier system configured to provide support beneath a foundation;

an adjustable pier cap comprising:

a cap plate having a top surface opposite a bottom surface;

a first collar portion extending away from the bottom surface of the cap plate;

a second collar portion configured to be coupled to the first collar portion; and an extendable support portion extending away from the top surface of the cap plate, wherein the extendable support portion is configured to move between a retracted position and an extended position;

a lift platform removably coupled to the adjustable pier cap, wherein the lift platform comprises a first plate seated upon the cap plate and a second plate seated upon the first plate; and a heave plate, wherein the first collar portion and the second collar portion of the adjustable pier cap are configured to couple the adjustable pier cap to the pier system, wherein the extendable support portion is configured to engage the heave plate when in the extended position.

2. The foundation support system of claim 1, wherein the pier system comprises a concentric pier system having a plurality of inner pier members and a plurality of outer pier members, wherein the plurality of inner pier members and the plurality of outer pier members are stacked concentrically when assembled, wherein each inner pier member of the plurality of inner pier members vertically overlaps a respective outer pier member when assembled.

3. The foundation support system of claim 2, the concentric pier system further comprising a pier base, the pier base having a bottom pier surface and a cylindrical wall extending away from the bottom pier surface, a first diameter of the cylindrical wall being equal to a second diameter of the plurality of outer pier members, wherein a height of the cylindrical wall vertically spaces respective outer pier members from respective inner pier members to provide a vertical overlap between respective outer pier members and respective inner pier members.

4. The foundation support system of claim 1, wherein the extendable support portion comprises:

a cylindrical tube having a first end opposite a second end, the first end affixed to the cap plate;

a threaded nut affixed to the cylindrical tube proximate the second end; and a threaded rod configured to move through the threaded nut.

5. The foundation support system of claim 4 further comprising a second nut affixed to an exposed end of the threaded rod, wherein the second nut is spaced away from the exposed end.

6. The foundation support system of claim 5, wherein the heave plate includes central opening aligned with the threaded rod.

7. The foundation support system of claim 6, wherein the second nut is spaced away from the exposed end of the threaded rod a distance equal to a thickness of the heave plate.

8. The foundation support system of claim 1, wherein the extendable support portion of the adjustable pier cap is concentrically aligned with the pier system.

9. The foundation support system of claim 1 further comprising a first lifting mechanism positioned on the lift platform on a first side of the adjustable pier cap and a second lifting mechanism positioned on the lift platform on a second side of the adjustable pier cap.

10. The foundation support system of claim 1, wherein the first collar portion and the second collar portion define an enclosure when the second collar portion is coupled to the first collar portion.

11. The foundation support system of claim 1, wherein the first collar portion is welded to the bottom surface of the cap plate.

12. The adjustable pier cap of claim 1, wherein the extendable support portion comprises:

a tube extending from the top surface of the cap plate to a terminal end, the terminal end having an opening; and an extension rod received in the tube through the opening, the extension rod movable between a first position associated with the extendable support portion being in the retracted position and a second position associated with the extendable support being in the extended position.

13. The adjustable pier cap of claim 12, wherein the extendable support portion further comprises:

the opening at the terminal end of the tube being a threaded opening; and the extension rod having threads that engage the tube at the threaded opening.

14. The adjustable pier cap of claim 13, wherein the terminal end of the tube comprises a threaded nut fastened to, and concentrically aligned with, the tube.

15. The adjustable pier cap of claim 1, wherein the second collar portion is removably coupled to the first collar portion.

16. The adjustable pier cap of claim 15, wherein the first collar portion and a second collar portion, when coupled, define a cylindrical wall.

17. A foundation support system comprising:

a pier system configured to provide support beneath a foundation;

a pier cap coupled to a top portion of the pier system;

a heave plate having a catch, the catch configured to suspend a support member in vertical alignment above the pier system;

the support member suspended from the catch and vertically aligned with the pier cap, the support member having an extension portion configured to move between a retracted position and an extended position, wherein the extension portion engages the pier cap when moved to the extended position.

* * * * *